US011664623B2

(12) United States Patent
Yu et al.

(10) Patent No.: US 11,664,623 B2
(45) Date of Patent: May 30, 2023

(54) PLUG CONNECTOR HAVING A LATCH AND A ROD SLIDABLE TO RELEASE THE LATCH

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventors: Yang-Yang Yu, Kunshan (CN); Cai-Yuan Wang, Kunshan (CN); Zhi-Yong Zhou, Kunshan (CN); Ying-Xing Ma, Kunshan (CN); Chien-Hsun Huang, New Taipei (TW)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 17/384,664

(22) Filed: Jul. 23, 2021

(65) Prior Publication Data

US 2022/0029355 A1 Jan. 27, 2022

(30) Foreign Application Priority Data

Jul. 24, 2020 (CN) ..... 202010722427.8

(51) Int. Cl.
*H01R 13/42* (2006.01)
*H01R 13/633* (2006.01)
(Continued)

(52) U.S. Cl.
CPC ..... *H01R 13/6335* (2013.01); *H01R 13/42* (2013.01); *H01R 13/502* (2013.01); *H01R 13/6275* (2013.01); *H01R 12/79* (2013.01)

(58) Field of Classification Search
CPC ..... H01R 13/6275; H01R 13/629; H01R 13/62933; H01R 13/6335
See application file for complete search history.

(56) References Cited

U.S. PATENT DOCUMENTS 7,083,459 B1 8/2006 Wu
7,281,937 B2 10/2007 Reed
(Continued)

FOREIGN PATENT DOCUMENTS

CN 208797273 U 4/2019
CN 210245775 U 4/2020
CN 111326886 A 6/2020

*Primary Examiner* — Truc T Nguyen
(74) *Attorney, Agent, or Firm* — Ming Chieh Chang

(57) ABSTRACT

A plug connector includes: an insulative housing having a front mating end and a rear terminating end; a conductive module received in the insulative housing and exposed to the front mating end; a rod mounted to the insulative housing; a latch mounted to the insulative housing, the latch including a securing portion, a latching portion movable between a latched position and a released position, and an operating portion operable by the rod to move the latching portion to the released position; and a pulling tab connected to the rod, wherein the insulative housing includes a pair of grooves and the rod is slidable in the pair of grooves by the pulling tab to operate the operating portion of the latch to move the latching portion to the released position.

5 Claims, 16 Drawing Sheets

(51) Int. Cl.

| | |
|---|---|
| ***H01R 13/627*** | (2006.01) |
| ***H01R 13/502*** | (2006.01) |
| *H01R 12/79* | (2011.01) |

(56) References Cited

U.S. PATENT DOCUMENTS

| | | | | |
|---|---|---|---|---|
| 9,590,355 | B2 * | 3/2017 | Kawamura | H01R 13/633 |
| 10,601,181 | B2 | 3/2020 | Lu et al. | |
| 2016/0149332 | A1 * | 5/2016 | Weber | H01R 13/6335 439/660 |
| 2018/0275357 | A1 * | 9/2018 | Yizhi | G02B 6/4292 |
| 2020/0321727 | A1 | 10/2020 | Li et al. | |

* cited by examiner

PLUG CONNECTOR HAVING A LATCH AND A ROD SLIDABLE TO RELEASE THE LATCH

BACKGROUND OF THE INVENTION

1. Field of the Invention

The present invention relates to a plug connector comprising an insulative housing, a conductive module received in the insulative housing, a rod mounted to the insulative housing, a latch mounted to the insulative housing, and a pulling tab connected to the rod, wherein the rod is operable by the pulling tab to release the latch from a locked position with a mating connector.

2. Description of Related Arts

China Patent No. 208797273 discloses a plug connector comprising an insulative housing, a conductive module received in the insulative housing, a latch mounted to the insulative housing, and a pulling tab directly connected to the latch, wherein the pulling tab extends through a hole provided on the insulative housing and the latch is operable by the pulling tab to release the latch from a locked position with a mating connector.

SUMMARY OF THE INVENTION

A plug connector comprises: an insulative housing having a front mating end and a rear terminating end; a conductive module received in the insulative housing and exposed to the front mating end; a rod mounted to the insulative housing; a latch mounted to the insulative housing, the latch including a securing portion, a latching portion movable between a latched position and a released position, and an operating portion operable by the rod to move the latching portion to the released position; and a pulling tab connected to the rod, wherein the insulative housing includes a pair of grooves and the rod is slidable in the pair of grooves by the pulling tab to operate the operating portion of the latch to move the latching portion to the released position.

DETAILED DESCRIPTION OF THE PREFERRED EMBODIMENT

Figure 1:
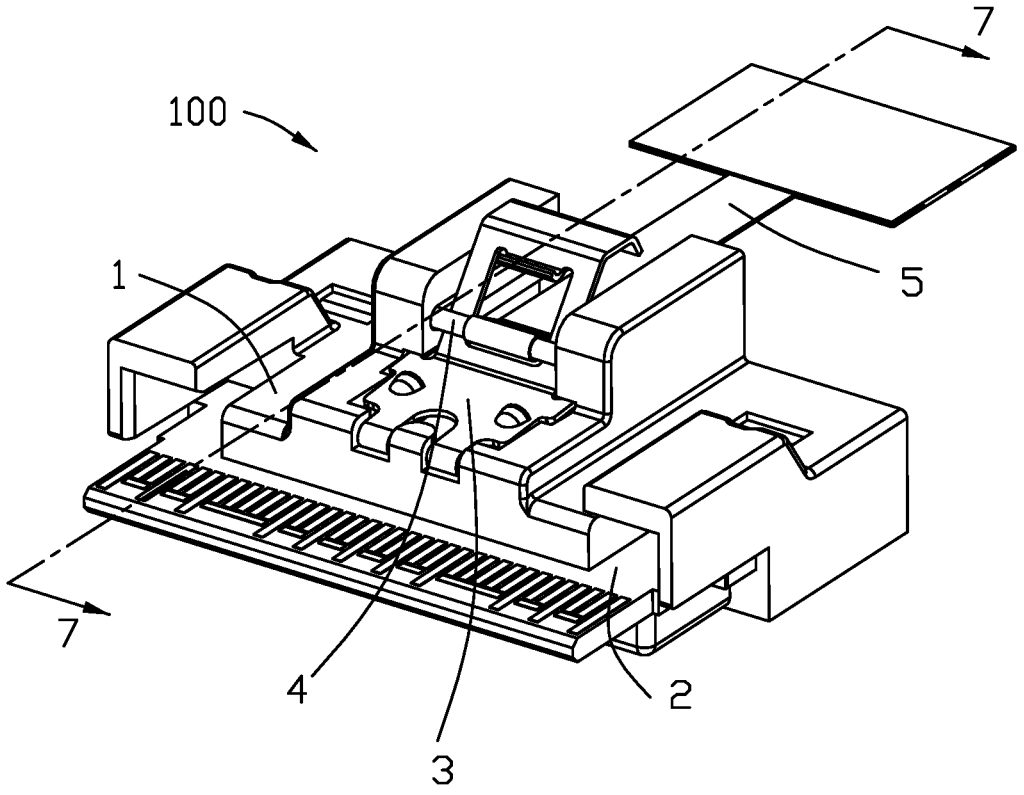
FIG. 1 is a perspective view of a plug connector in accordance with a first embodiment of the present invention.
Figure 2:
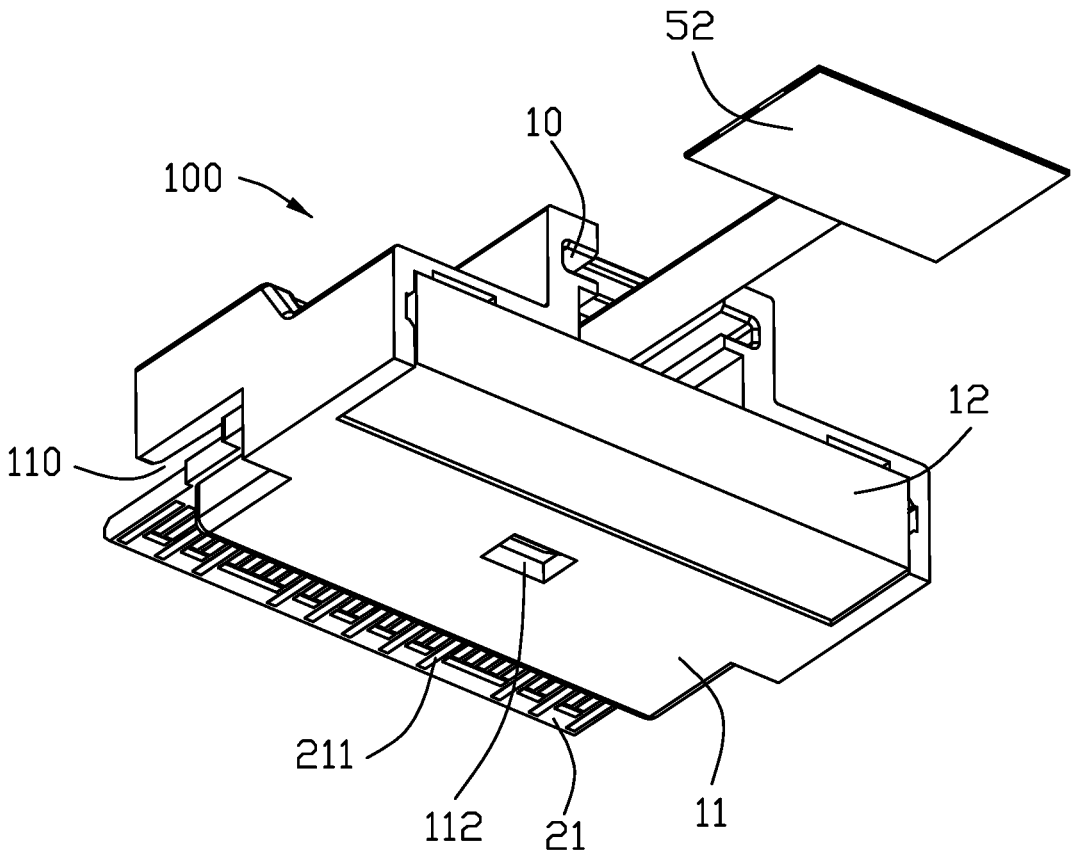
FIG. 2 is a view similar to FIG. 1 but from another perspective.
Figure 3:
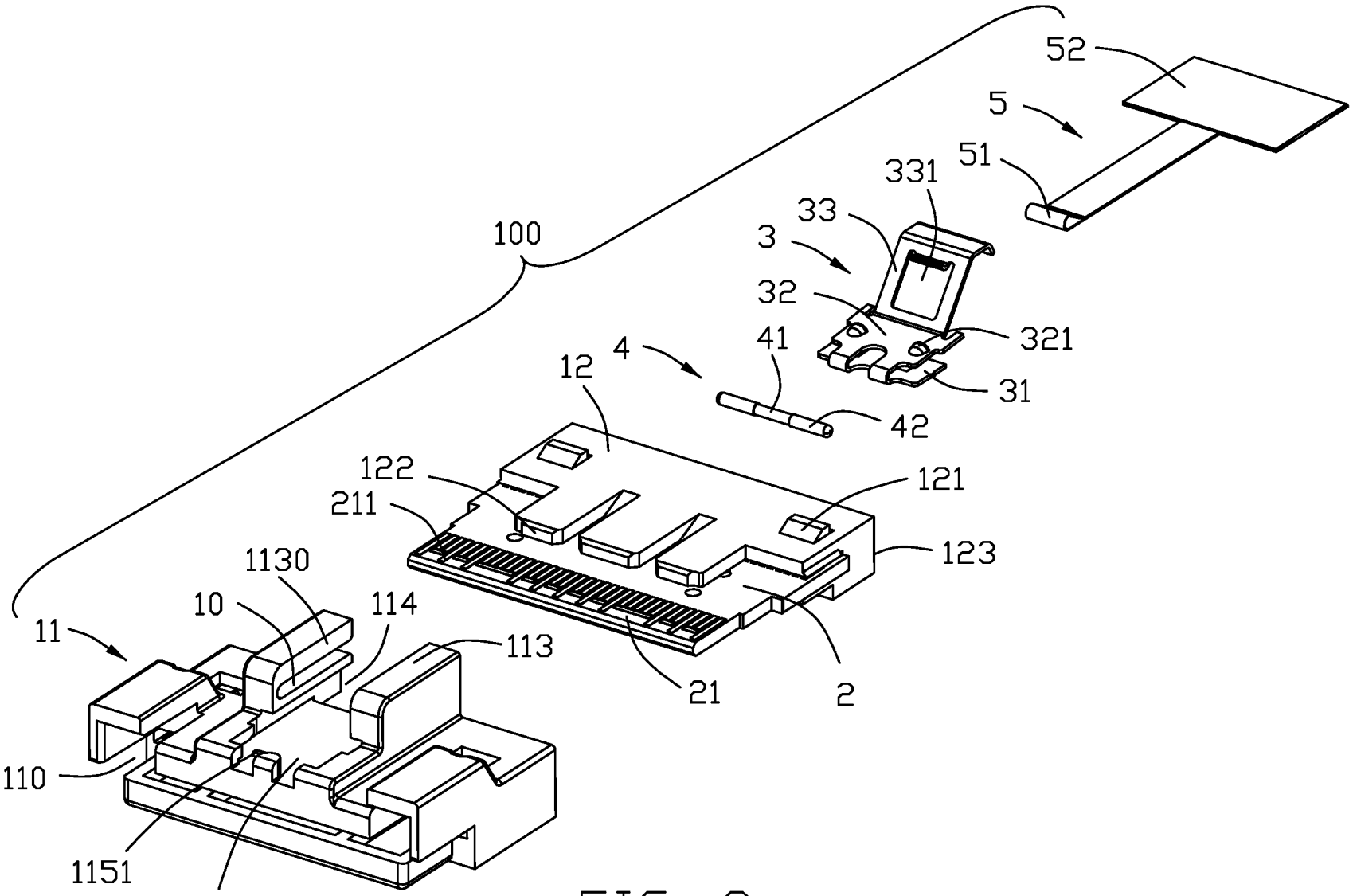
FIG. 3 is an exploded view of FIG. 1.
Figure 4:
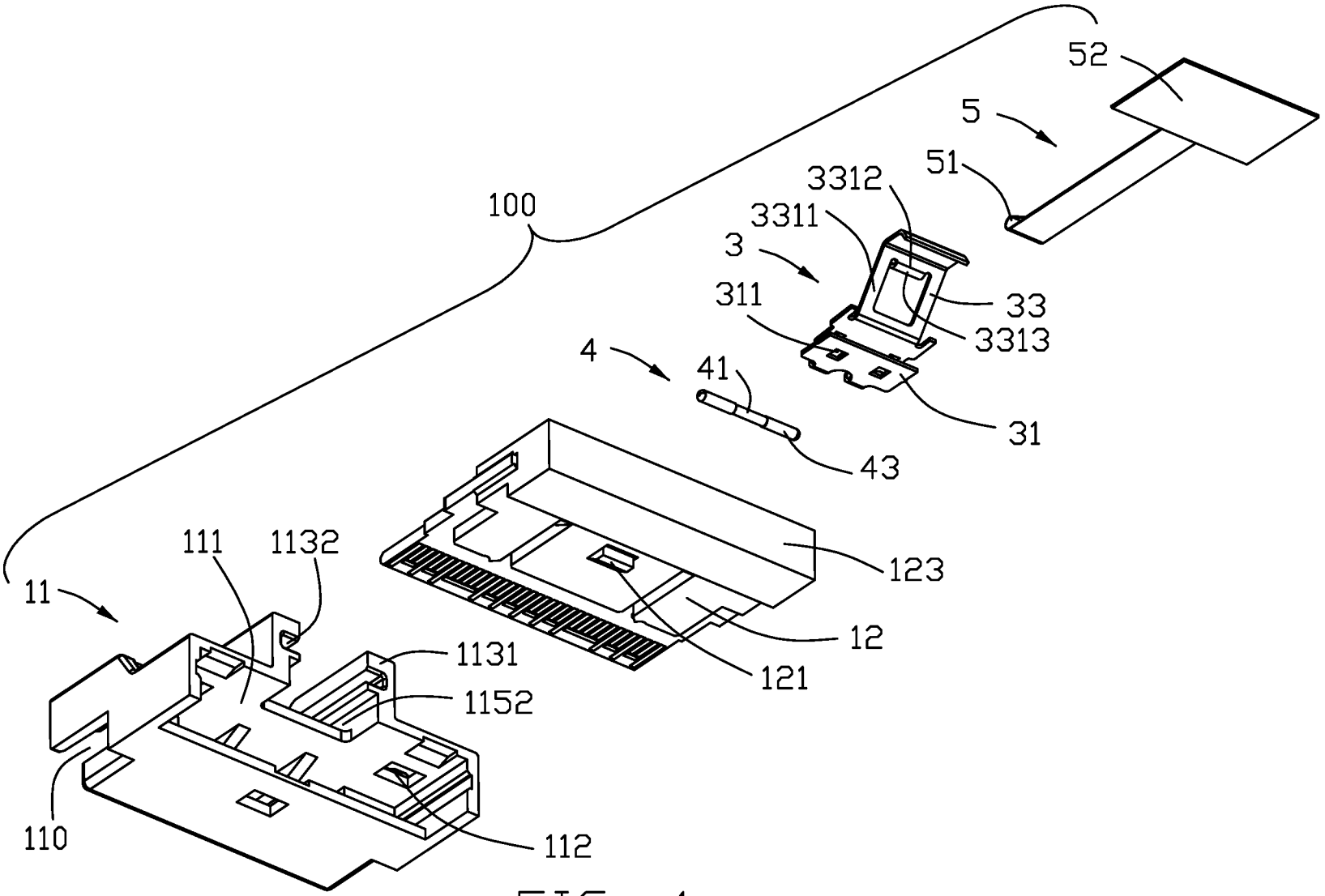
FIG. 4 is an exploded view of FIG. 2.
Figure 5:
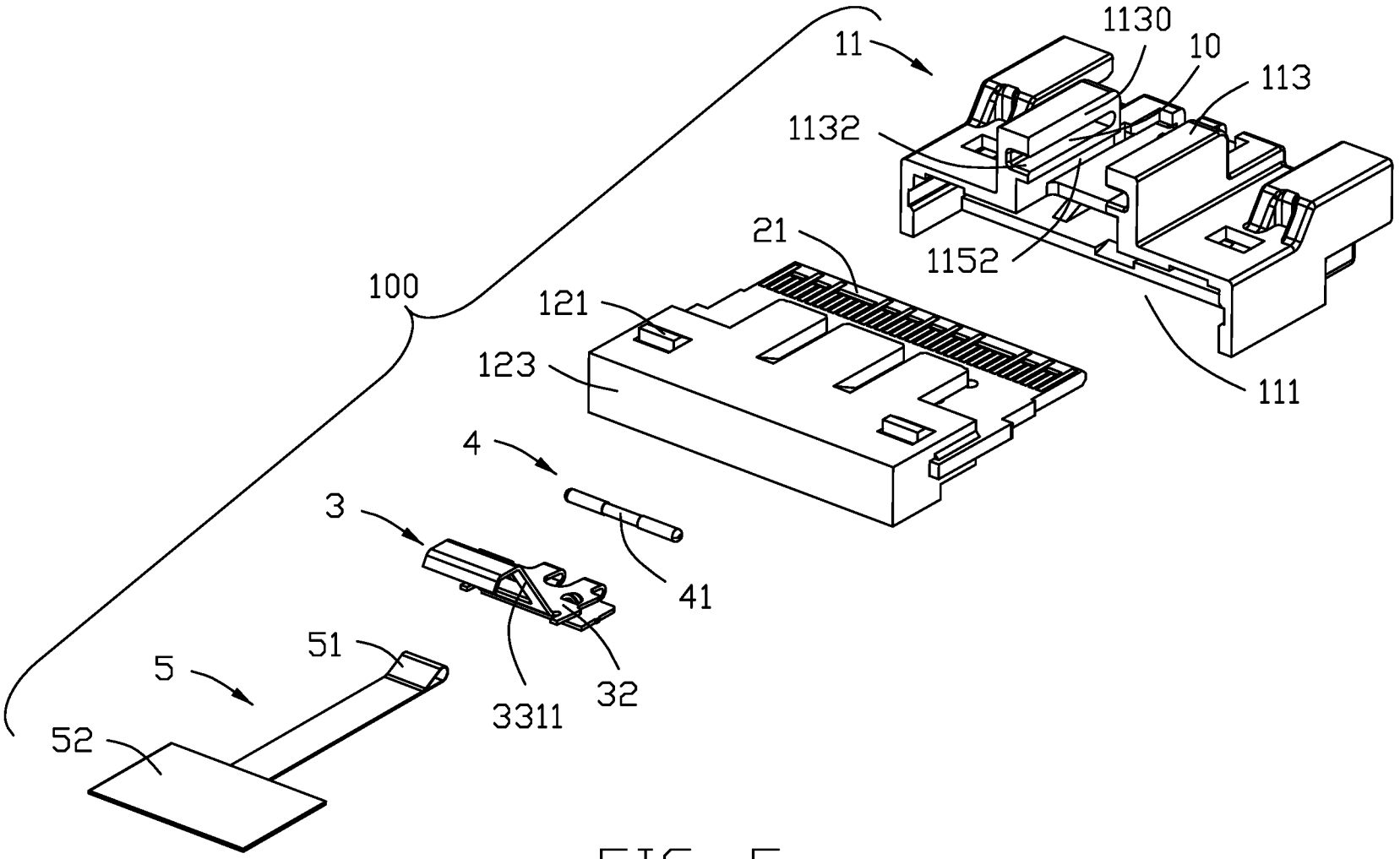
FIG. 5 is a view similar to FIG. 4 but from another perspective.
Figure 6:
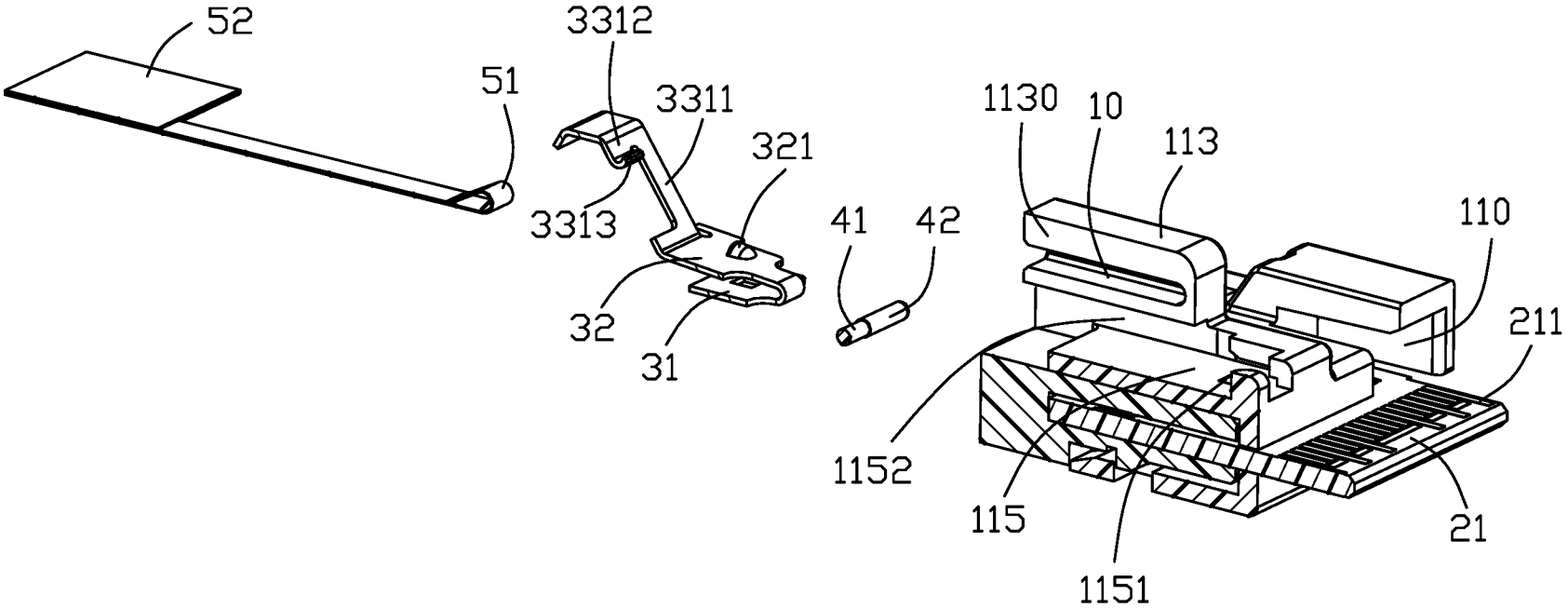
FIG. 6 is a view similar to FIG. 5 but shown in cross-section from another perspective.
Figure 7:
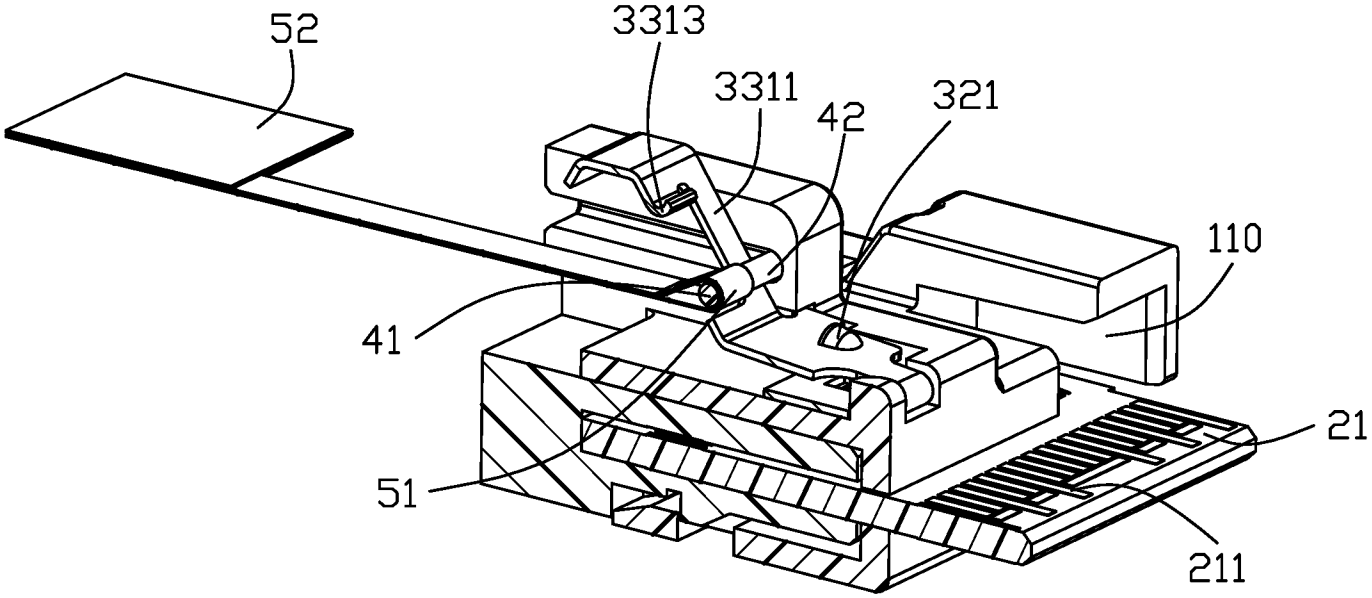
FIG. 7 is a view similar to FIG. 6 but shown in assembled state.
Figure 8:
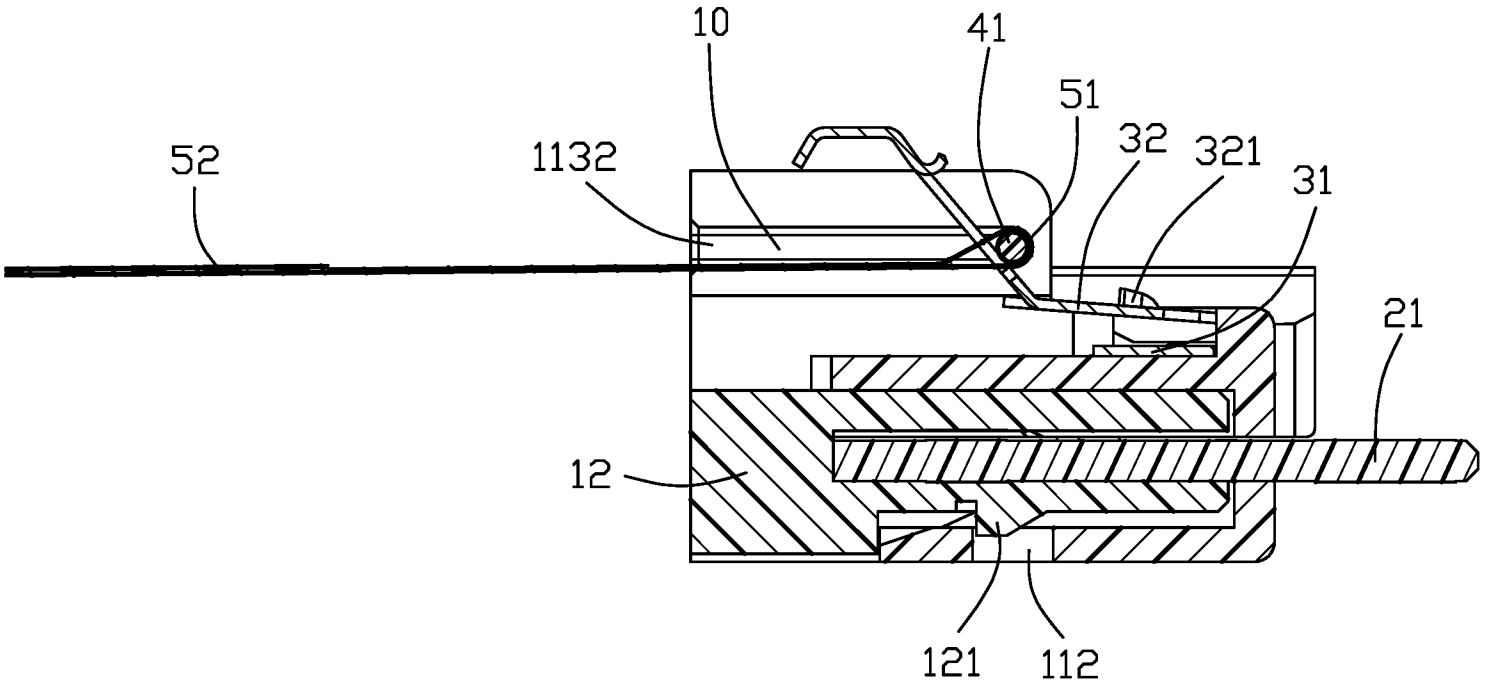
FIG. 8 is a cross-sectional view similar to FIG. 7 but taken along line A-A in FIG. 1.

Referring to FIGS. 1-8, a plug connector 100 comprises an insulative housing 1 having a front mating end for mating with a complementary connector and a rear terminating end for accommodating one or more cables, a conductive module such as a printed circuit board (PCB) 2 received in the insulative housing 1 and exposed to the front mating end, a rod 4 mounted to the insulative housing 1, a latch 3 mounted to the insulative housing 1, and a pulling tab 5 connected to the rod 4. The pulling tab 5 is used for moving the rod 4 to press down the latch 3 so that the latch 3 may be released from the complementary connector in a manner generally known in this art.

The latch 3 includes a securing portion 31 secured to the insulative housing 1, a latching portion 32 resiliently movable relative to the securing portion 31 between a latched position and a released position with respect to the complementary connector, and an operating portion 33 operable by the rod 4 to move the latching portion 32 to the released position. The latching portion 32 has a pair of protrusions 321 for locking to features such as holes on the complementary connector. The insulative housing 1 includes a pair of grooves 10 and the rod 4 is slidable in the pair of grooves 10 by the pulling tab 5 to operate the operating portion 33 of the latch 3 to move the latching portion 32 to the released position. The operating portion 33 has a hole 331 for the pulling tab 5 to extend through. The pulling tab 5 has a connecting portion 51 and a holding portion 52. When the pulling tab 5 is not operated, the latching portion 32 is at the latched position and the rod 4 is urged by the operating portion 33 of the latch 3 to be confined attends of the pair of grooves 10. In other applications, if desired, the rod 4 may not be urged and confined when the pulling tab 5 is not operated. The rod 4 may be fit in dimension and slides smoothly in the grooves 10. The operating portion 33 is angled relative to the latching portion 32 so that the pulling tab 5 may be pulled along a front-to-back direction or under a wide range of angles relative to such direction conforming to the angled operating portion 33 while maintaining smooth movement of the rod 4 in the grooves 10.

The insulative housing 1 may include a front housing part 11 and a rear housing part 12. The front housing part 11 has a front opening 110 and a rear opening 111. The rear housing part 12 has plural protrusions 121 and the front housing part 11 has corresponding holes 112 engaging the protrusions 121. The PCB 2 is mounted to the rear housing part 12 and extends in the front opening 110. The PCB 2 has a front mating part 21 extending forward beyond a front end face 122 of the rear housing part 12. The mating part 21 has conductive pads 211 on two opposite surfaces thereof. Cables are terminated to a rear end of the PCB 2 and extend rearward beyond a rear end face 123 of the rear housing part 12. The latch 3 is secured to an upper side of the front housing part 11. The upper side of front housing part 11 further has a pair of protruding walls 113 defining a receiving space 114 therebetween for accommodating the operating portion 33. The pair of grooves 10 are formed at inner surfaces 1130 of the protruding walls 113, respectively, and open rearward through rear end faces 1131 of the protruding walls 113 to form a mounting opening 1132 for mounting the rod 4 in the grooves 10. The pair of grooves 10 extends in the front-to-back direction and is located above a rear section of the latching portion 32. The rod 4 is preferably a metallic cylinder for performing a smooth sliding movement in the grooves 10. The upper side of front housing part 11 has a receiving channel 115 in front of the protruding walls 113 for receiving the securing portion 31. A pair of protrusions 1151 are formed in the receiving channel 115 for engaging corresponding holes 311 of the securing portion 31. A mounting opening 1152 continues the receiving channel 115 rearward for mounting of the securing portion 31.

In the first embodiment, the operating portion 33 of the latch 3 has a pair of side arms 3311 and an upper cross arm 3312 connecting the side arms 3311. The cross arm 3312 has a curved section 3313 for blocking a further rearward movement of the pulling tab 5 and therefore the rod 4. The rod 4 has a middle section 41 for coupling to the connecting portion 51 of the pulling tab 5, two side sections 42 for bearing against the side arms 3311 of the operating portion 33, and two end sections 43 for engaging the grooves 10. A diameter of the middle section 41 is less than a diameter of the side section 42 so that the connecting portion 51 of the pulling tab 5 is kept at the middle section 41 stably.

Figure 9:
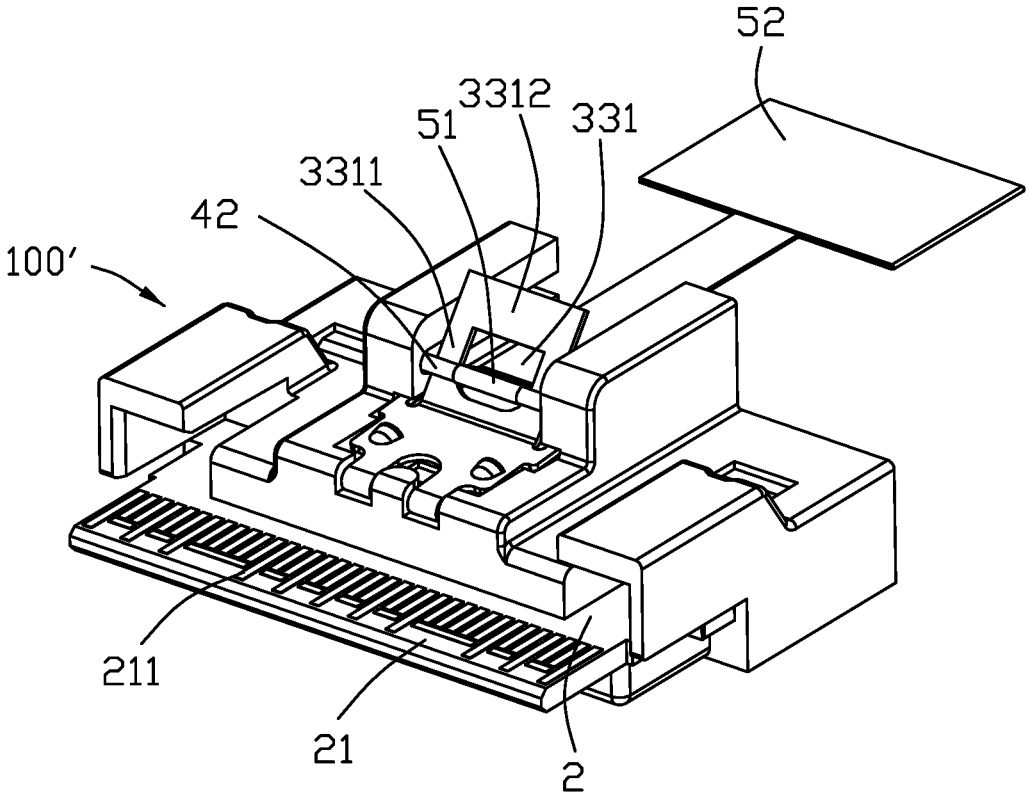
FIG. 9 is a perspective view of a plug connector in accordance with a second embodiment of the present invention.
Figure 10:
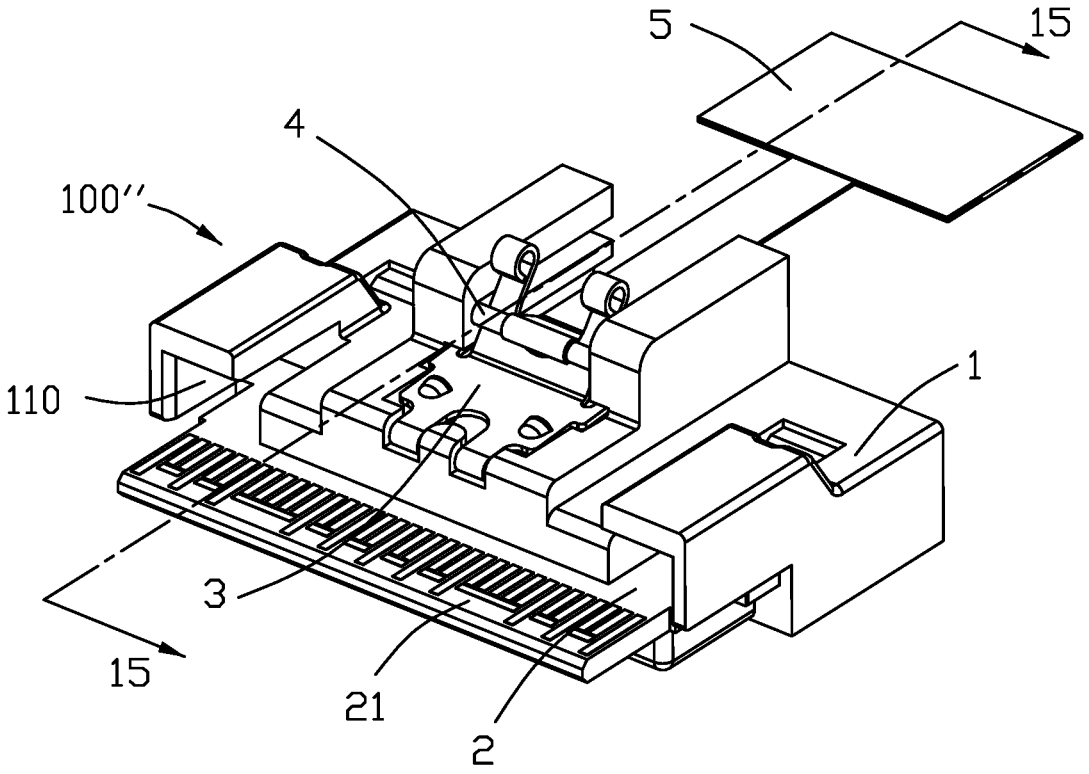
FIG. 10 is a perspective view of a plug connector in accordance with a third embodiment of the present invention.
Figure 11:
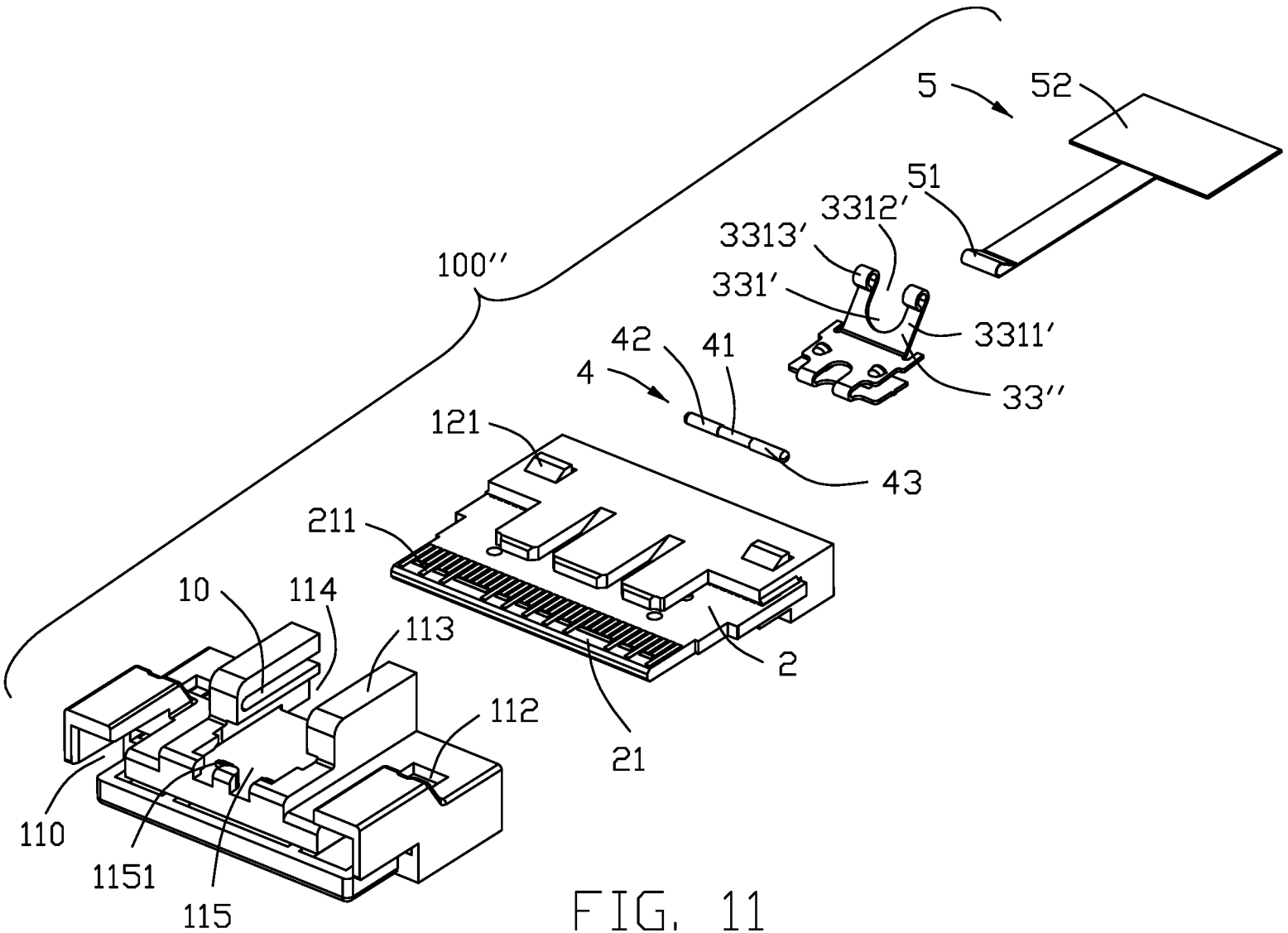
FIG. 11 is an exploded view of the plug connector in FIG. 10.
Figure 12:
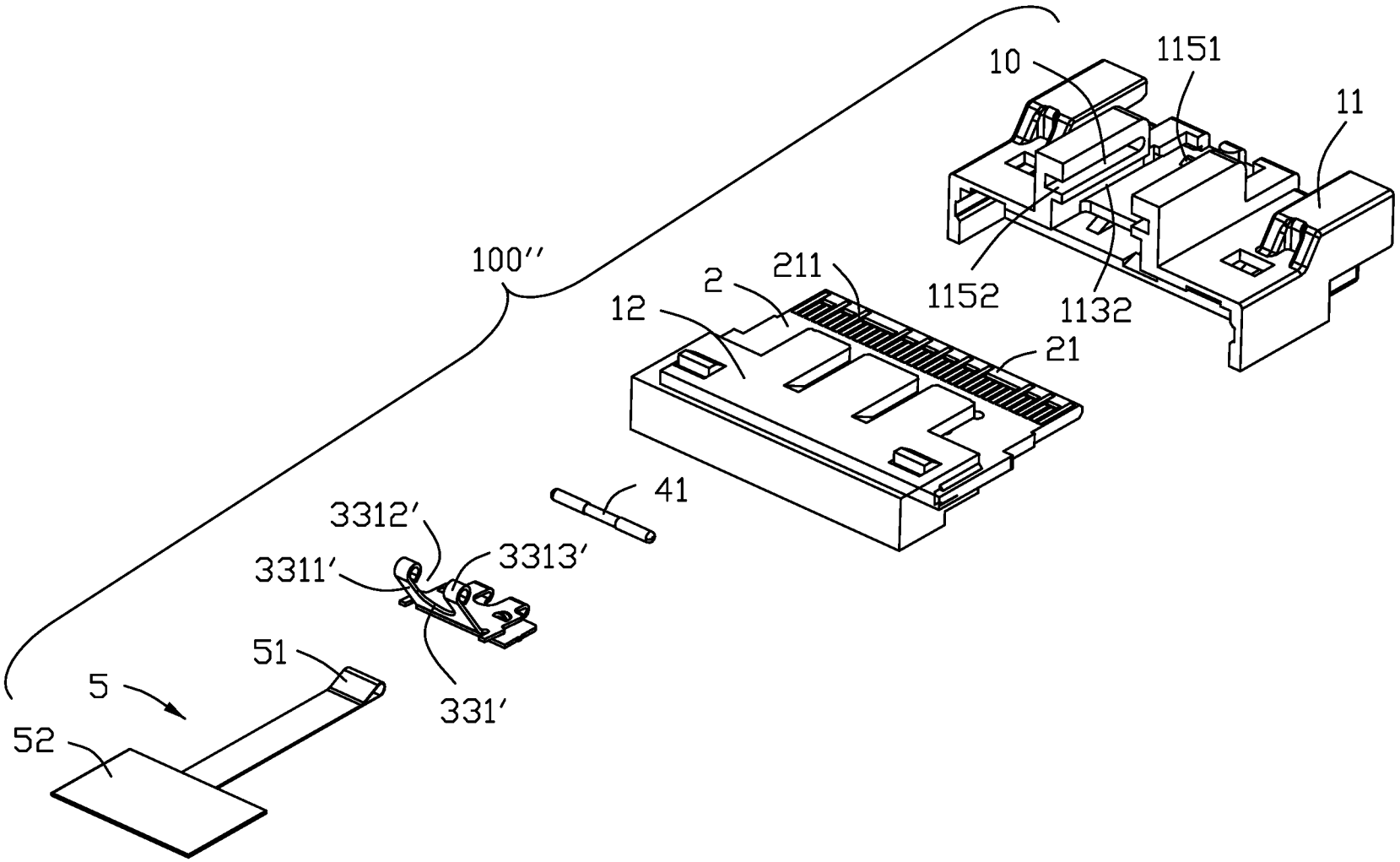
FIG. 12 is a view similar to FIG. 11 but from another perspective.
Figure 13:
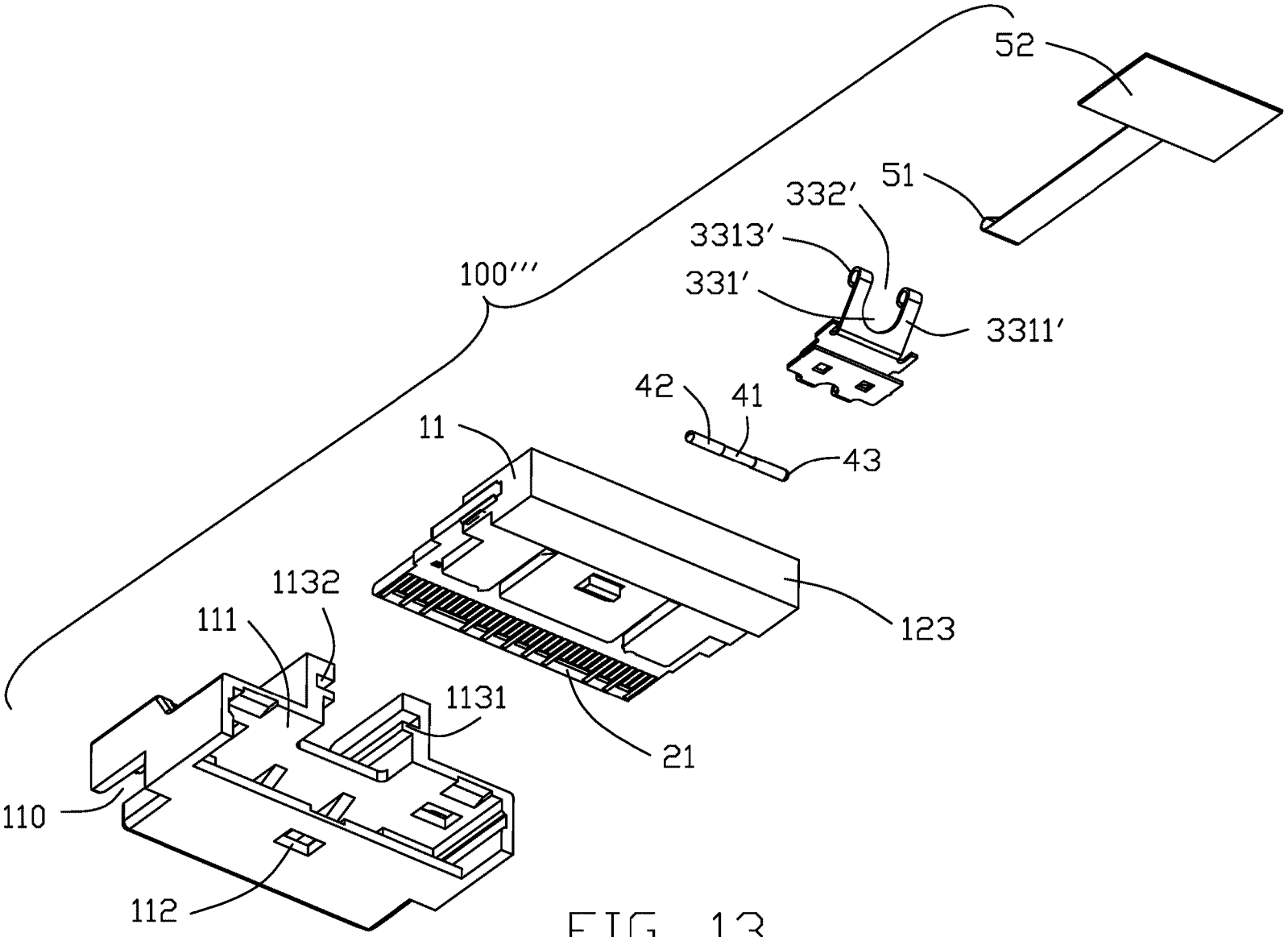
FIG. 13 is a view similar to FIG. 12 but from another perspective.
Figure 14:
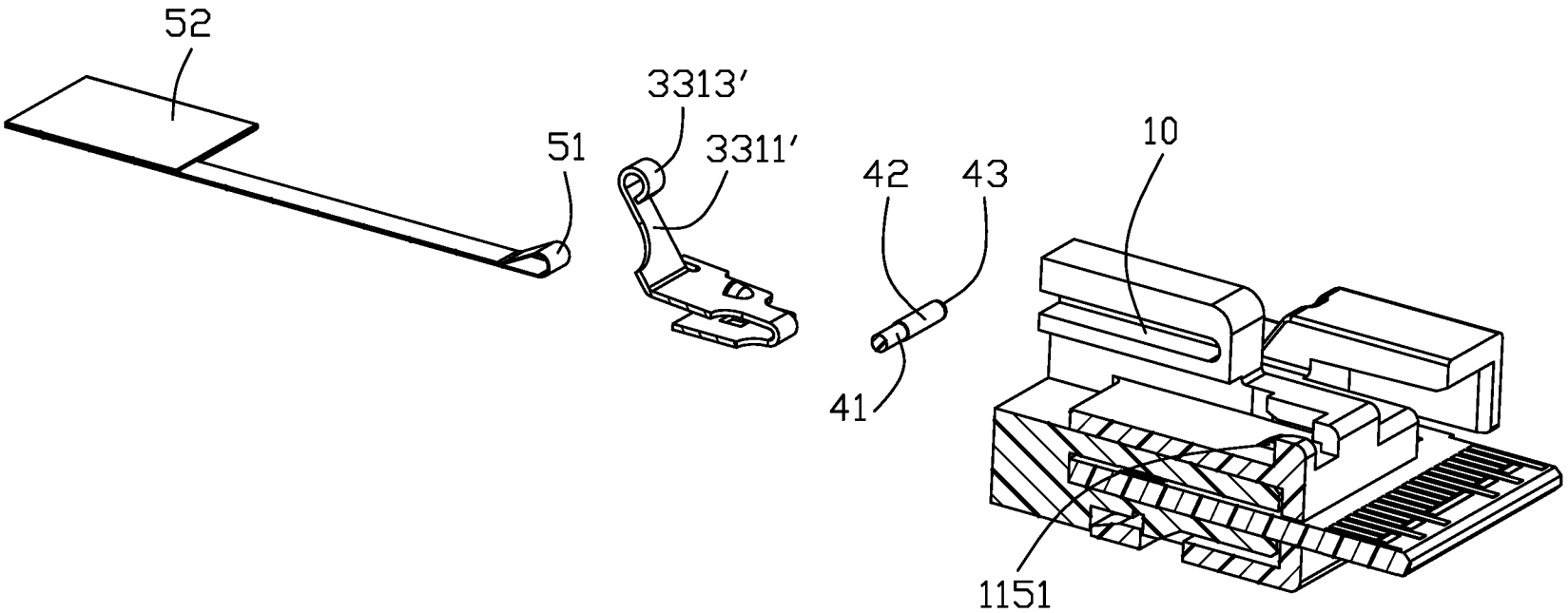
FIG. 14 is a view similar to FIG. 13 but shown in cross-section from another perspective.
Figure 15:
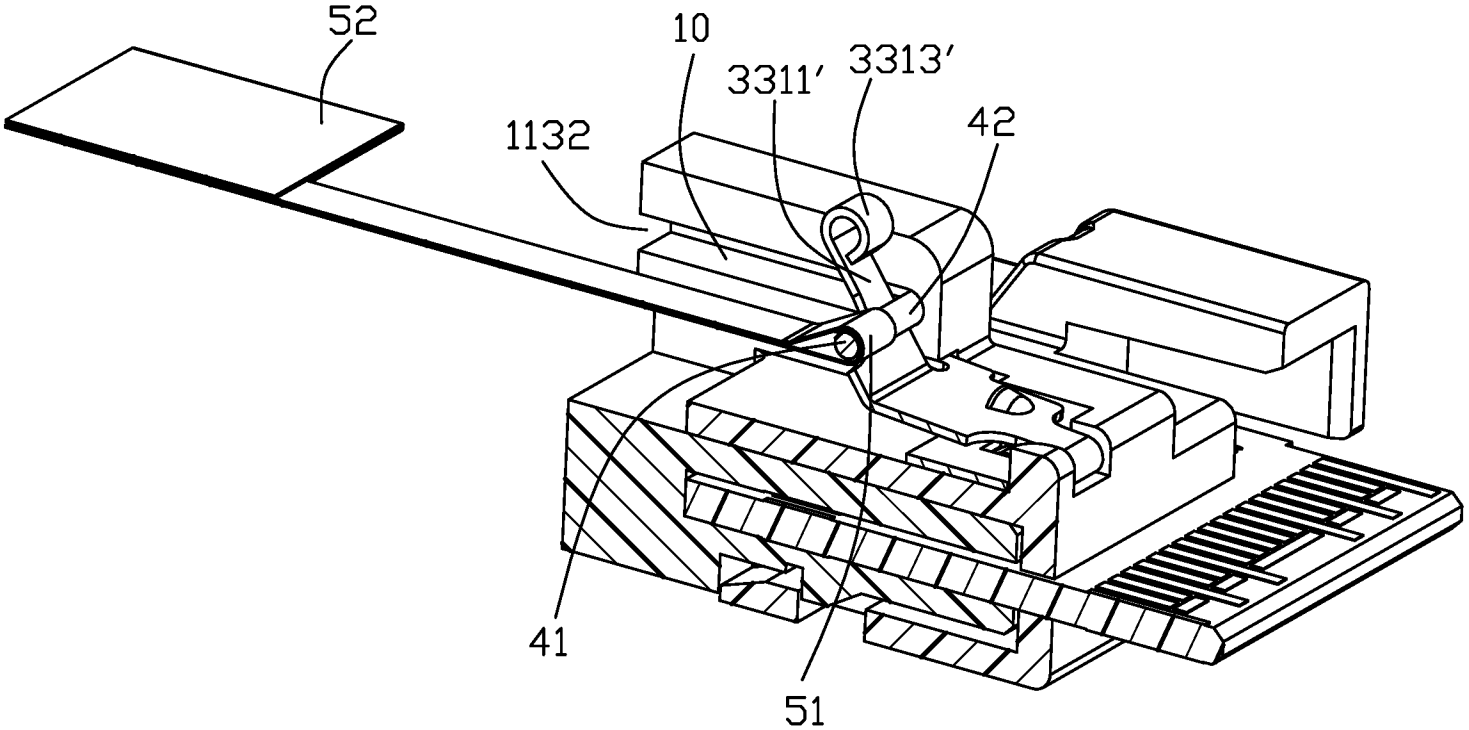
FIG. 15 is a view similar to FIG. 14 but shown in assembled state.
Figure 16:
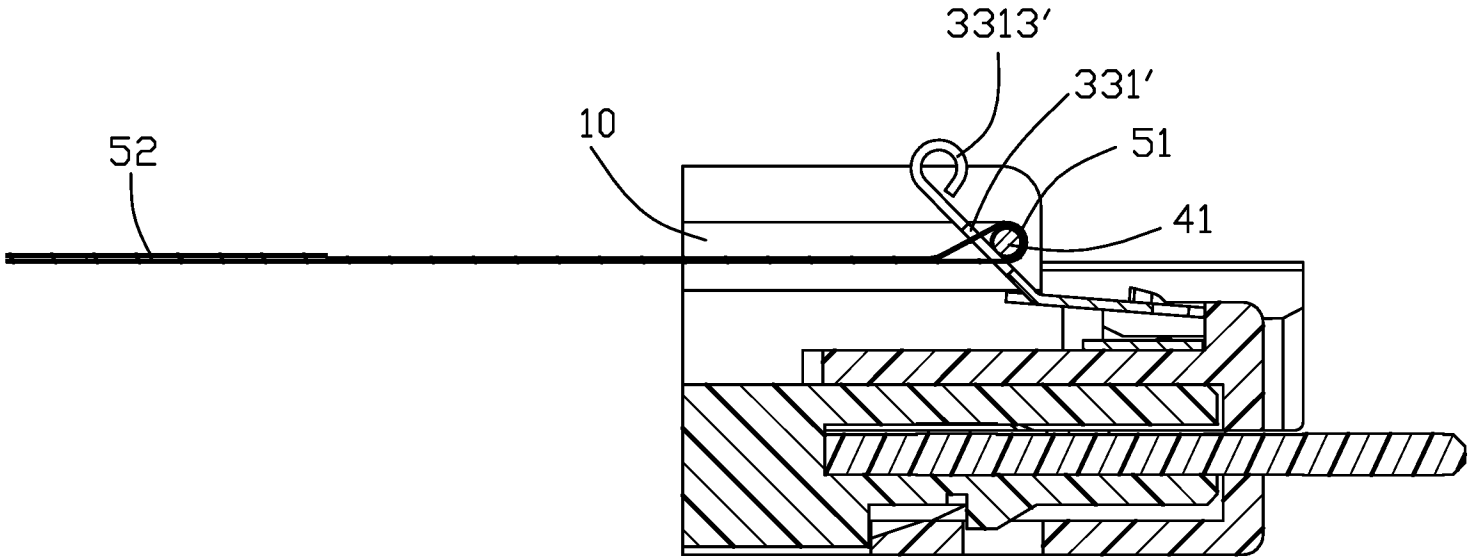
FIG. 16 is a cross-sectional view similar to FIG. 15 but taken along line B-B in FIG. 10.

The second embodiment in FIG. 9 shows a plug connector 100' including an operating portion 33 which has a pair of side arms 3311 and a cross arm 3312 but not a curved section. Therefore, in the second embodiment, the cross arm 3312 functions as a limiting end for blocking a further rearward movement of the pulling tab 5 and therefore the rod 4.

The third embodiment in FIGS. 10-16 shows a plug connector 100" including an operating portion 33' which has a pair of side arms 3311' and a notch 331' therebetween but not across arm. Rather, each side arm 3311' has a curved section 3313' for blocking a further rearward movement of the rod 4 and therefore the pulling tab 5.

What is claimed is:

1. A plug connector comprising:

an insulative housing having a front mating end and a rear terminating end;

a conductive module received in the insulative housing and exposed to the front mating end;

a rod mounted to the insulative housing;

a latch mounted to the insulative housing, the latch including a securing portion, a latching portion movable between a latched position and a released position, and an operating portion operable by the rod to move the latching portion to the released position; and a pulling tab connected to the rod; wherein the latching portion is connected between the securing portion and the operating portion; and the insulative housing includes a pair of grooves and the rod is slidable in the pair of grooves by the pulling tab to urge the operating portion of the latch toward the insulative housing to move the latching portion to the released position.

2. The plug connector as claimed in claim 1, wherein the rod is urged by the operating portion of the latch to be slidably retained to the pair of grooves while the latching portion is at the latched position.

3. The plug connector as claimed in claim 1, wherein the operating portion of the latch has an upper section for blocking a further rearward movement of the rod.

4. The plug connector as claimed in claim 1, wherein the pair of grooves extends in a front-to-back direction.

5. The plug connector as claimed in claim 1, wherein the insulative housing includes a front housing part and a rear housing part, the front housing part has a pair of protruding walls, and the pair of grooves are formed at inner surfaces of the protruding walls, respectively.

* * * * *